US007620356B2

(12) United States Patent
Moteki et al.

(10) Patent No.: US 7,620,356 B2
(45) Date of Patent: Nov. 17, 2009

(54) FIXING APPARATUS AND IMAGE FORMING APPARATUS HAVING THE SAME

(75) Inventors: Junichi Moteki, Abiko (JP); Seiichiro Kameda, Abiko (JP); Youichi Chikugo, Toride (JP); Shinichiro Hosoi, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 458 days.

(21) Appl. No.: 11/685,700

(22) Filed: Mar. 13, 2007

(65) Prior Publication Data

US 2007/0217839 A1 Sep. 20, 2007

(30) Foreign Application Priority Data

Mar. 15, 2006 (JP) ..... 2006-071871

(51) Int. Cl.
*G03G 15/20* (2006.01)

(52) U.S. Cl. ..... 399/329; 399/122

(58) Field of Classification Search ..... 399/107, 399/122, 320, 328, 329, 397, 400; 219/216
See application file for complete search history.

(56) References Cited

U.S. PATENT DOCUMENTS 5,365,322 A 11/1994 Hamada et al.
6,647,216 B2 * 11/2003 Tanaka ..... 399/21
7,280,775 B2 * 10/2007 Kubochi et al. ..... 399/33

FOREIGN PATENT DOCUMENTS

JP 06-175524 A 6/1994

* cited by examiner

*Primary Examiner*—Hoan H Tran
(74) *Attorney, Agent, or Firm*—Canon U.S.A., Inc. I.P. Division

(57) ABSTRACT

A sheet conveying apparatus is provided which includes a first rotary member; a second rotary member configured to convey a sheet with the first rotary member and which is separable from and in contact with the first rotary member; a sheet detecting member which is movable by being pressed by the sheet; and a detecting sensor configured to detect a presence or absence of the sheet based on a position of the member. The sheet detecting member is movable between a detecting position for detecting a presence or absence of the sheet by the detecting sensor in which the sheet detecting member can be pressed by the sheet and a retreat position in which the sheet detecting member is retreated from a sheet conveyed, and the sheet detecting member is moved to the detecting position from the retract position in association with a movement of the second rotary member away from the first rotary member.

7 Claims, 12 Drawing Sheets

FIXING APPARATUS AND IMAGE FORMING APPARATUS HAVING THE SAME

BACKGROUND OF THE INVENTION

1. Field of the Invention

The present invention relates to a fixing apparatus for fixing a toner image.

2. Description of the Related Art

The conventional image forming apparatus such as printer and copier performs fixation of a toner image on a sheet by forming a toner image using an electrophotographic recording method, and by transferring the toner image onto the sheet, then by applying heat and pressure to the sheet to fix the toner image on the sheet.

That type of fixing apparatus for fixing the toner image onto the sheet includes the one, which has a metal roller having a heater therein, and has an elastic fixing belt in pressure contact with the metal roller.

FIG. 10 illustrates a general structure of a color laser printer as an example of an image forming apparatus having the conventional fixing apparatus of the above structure. In FIG. 10, a color laser printer 100 has a color laser printer main body (hereinafter referred to as the "printer main body") 101, an image forming portion 102 to form an image on a sheet P, and a fixing apparatus 105.

In the color laser printer 100, after a toner image is formed by the image forming portion 102, the toner image is transferred onto the sheet P. Then, the sheet P is sent to the fixing apparatus 105. After that, the sheet P is heated and pressed in the fixing apparatus 105 to fix the toner image onto the sheet.

As illustrated in FIG. 11, the fixing apparatus 105 has a rotatable fixing roller 510 and a fixing belt unit 53. The fixing roller 510 is driven by a drive source (not shown) to rotate in a direction indicated by the arrow A, while being heated by a halogen heater 520 disposed inside fixing roller 510. The surface temperature of the fixing roller 510 is controlled by a thermistor 525 located on the surface of the fixing roller 510 to keep the temperature constant.

The fixing belt unit 53 has a fixing belt 531 which is an endless belt, and a pressure pad portion 540 which is brought into pressure contact with the fixing roller 510 through the fixing belt 531 in a direction indicated by the arrow PF to form a fixing nip.

Here, the fixing belt 531 is passed around an inlet roller 532, a separation roller 533, and a steering roller 534. The separation roller 533 is made of metal such as stainless steel, and is brought into pressure contact with the fixing roller 510 through the fixing belt 531 in a direction indicated by the arrow SF. One end of the steering roller 534 is movable in directions indicated by the double-headed arrow B. The deviation of the fixing belt 531 can be corrected by moving the one end of the steering roller 534.

The pressure pad portion 540 is disposed between the inlet roller 532 and the separation roller 533, and has a base 541 made of metal such as stainless steel, a pressure pad 542, and a slide sheet 543 disposed between the pressure pad 542 and the fixing belt 531. The slide sheet 543 is made of PI film, while the pressure pad 542 is made of silicon rubber.

An oil felt 536 impregnated with silicone oil is disposed between the inlet roller 532 and the pressure pad 540. The oil felt 536 applies oil onto an inner surface of the fixing belt 531 so that the friction force between the fixing belt 531 and the slide sheet 543 decreases.

Here, for that type of conventional fixing apparatus 105, unless the fixing roller 510 and the fixing belt 531 in a waiting operation are kept at a specified temperature, the next image formation output takes a time until the fixing roller 510 and the fixing belt 531 reach the specified temperature. Therefore, even in the waiting operation, the fixing roller 510 and the fixing belt 531 are required to be kept heated.

By the way, the uses of forming color image have been increasing in recent years. Accordingly, in addition to the ability of outputting an image of the normal quality, the image forming apparatus is required further to have the ability of outputting a high gloss image of a quality comparable to a silver halide photography. To this point, a coat paper is used in some cases as a sheet to improve the color-forming property of the toner image and the quality of the image. That type of coat paper is prepared by coating a coat layer comprising synthetic resin on the surface of the sheet at a thickness of several tens of micrometers.

When the fixing apparatus 105 fixes a toner image on a coat paper after the toner image is transferred onto the coat paper, if an excess heat is applied to the coat paper, the water in the coat paper evaporates and the thus evaporated water may partially destroys the coat layer applied on the surface of the sheet. If the coat layer is destroyed, the image loses the smoothness. In particular, the fixing apparatus using the fixing belt has a wide nip, which applies the large amount of heat to the coat paper, so that such a fixing apparatus likely poses the above problem.

In this regard, according to the related art, when the apparatus is in a waiting operation, contrary to the image forming operation mode illustrated in FIG. 12A, the fixing belt unit 53 is retreated from the fixing roller 510 as illustrated in FIG. 12B, thus assuring non-contact between the fixing belt 531 and the fixing roller 510. Even when the fixing belt 531 is separated from the fixing roller 510, a heater 535 is provided in the inlet roller 532 to keep the temperature of the fixing belt 531 at the specified temperature.

In the state illustrated in FIG. 12B, the drive source (not shown) rotates the fixing belt 531 in a direction indicated by the arrow C, and the heater 535 in the inlet roller 532 heats the fixing belt 531 through the inlet roller 532 to keep the temperature of the fixing belt 531 constant by a thermistor 537.

The temperature of the fixing belt 531 is set to a temperature lower than the temperature of the fixing roller 510 to some extent, thereby reducing the heat applied to the backside of the coat paper to suppress the evaporation of water in the coat paper, thus preventing the occurrence of the above phenomenon.

Referring back to FIG. 11, a sheet presence or absence detecting sensor 580 is located on the upstream side of the fixing apparatus 105 in the sheet conveying direction to detect the presence or absence of the sheet at the fixing nip. The sheet presence or absence detecting sensor 580 has a shaft 582, a sensor lever 583 oscillatable centering on the shaft 582, and a photo-interrupter 584.

The sensor lever 583 has a contact portion 583*b* which projects by a spring (not shown) from an opening (not shown) above a sheet guide 570 when there is no sheet on a sheet guide 570, and a shutter portion 583*a* to shield the photo-interrupter 584.

When there is no sheet in the fixing nip, the sensor lever 583 moves so as the contact portion 583*b* to project above the sheet guide 570, as illustrated in FIG. 11, and moves to a position where the shutter portion 583*a* does not shield the photo-interrupter 584. When a sheet is in the fixing nip, or when the sheet is passing through the fixing nip, the sensor lever 583 is pressed by the sheet P to oscillate about the shaft 582, thereby moving the shutter portion 583*a* to a position to shield the photo-interrupter 584.

Even when the shutter portion 583*a* shields the photo-interrupter 584, the controller (not shown) neglects the signal of the sheet presence or absence detecting sensor 580 as far as the conveying of the sheet P is correctly conducted.

Once jamming of sheet occurred in the printer main body, the controller (not shown) forcefully retreats the fixing belt unit 53 with respect to the fixing roller 510, as illustrated in FIG. 12B. Furthermore, the controller detects the presence or absence of the sheet based on the signal generated from the sheet presence or absence detection sensor 580, and when the controller determines that the jammed sheet exists in the fixing nip based on the signal generated from the sheet presence or absence detecting sensor 580, the controller indicates the presence of sheet in the fixing nip.

If, however, the sensor lever 583 is used to detect the presence or absence of jammed sheet at the fixing nip as described above, the pressing of the sensor lever 583 induces deformation of the leading edge of the sheet P, which worsens the shape of sheet entering the fixing nip, or which results in unstable behavior of sheet. Once the sheet entering shape becomes worse, or the sheet behavior becomes unstable, there is a possibility to cause the poor fixation (defective image) on fixing the toner image in the fixing nip.

A measure to prevent the leading edge deformation of sheet P is that the sheet presence or absence detecting sensor is formed as a photo-coupler integrating an infrared luminous element with an infrared light-receiving element to detect the presence or absence of the sheet by irradiating the infrared light to the backside of the sheet, (refer to, for example, Japanese Patent Application Laid-Open No. H06-175524).

With the conventional fixing apparatus and image forming apparatus detecting the presence or absence of a sheet using that type of photo-coupler, there is a need of forming a hole in the sheet guide to irradiate the infrared light to the backside of the sheet. With that hole, however, toner and paper dust may pass through the hole to adhere to the photo-coupler, which raises a problem of failing in the detection of the presence or absence of the sheet.

To this point, for example, it is considered to project the sensor lever of the sheet presence or absence detecting sensor to above the sheet guide only when the detection of the presence or absence of a sheet is required, while a solenoid usually retreats the sensor lever from the sheet guide(refer to, Japanese Patent Application Laid-Open No. H06-175524).

Although the above construction can prevent the deformation of leading edge of the sheet P, the construction presents other problems of a cost increase caused by the addition of a drive source such as a solenoid, an additional space for installing the solenoid, and an additional drive controller for the solenoid.

Furthermore, when the sensor lever is used to detect the presence or absence of the sheet, it is necessary to provide the sheet guide with an opening through which the sensor lever can be projected to above and retreated from the sheet guide. When, however, the sensor lever is retreated from the sheet guide, the leading edge of a sheet may be caught by the opening. Once the leading edge of the sheet is caught by the opening, the shape of the sheet entering fixing nip may be deteriorated so that there is a possibility that a poor fixing occurs.

SUMMARY OF THE INVENTION

The present invention has been derived to overcome the disadvantages of the aforementioned conventional image forming apparatuses. Further, an aspect of the present invention is to provide a fixing apparatus, an image forming apparatus and sheet conveying apparatus, which can simplify structure the apparatus.

According to an aspect of the present invention, a fixing apparatus is provided having a fixing rotary member and a pressure rotary member, wherein the pressure rotary member is configured to be separable from and in pressure contact with the fixing rotary member, and wherein the fixing rotary member and the pressure rotary member are configured to fix a toner image onto a sheet. The fixing apparatus includes a pressure unit which includes the pressure rotary member and which is configured to be movable between a fixing position in which the pressure rotary member is in pressure contact with the fixing rotary member and a waiting position in which the pressure rotary member is separated from the fixing rotary member; a guide member which forms a conveying path to guide a sheet on which the toner image is fixed by the fixing rotary member and the pressure rotary member; a sheet detecting member which is configured to be movable by being pressed by the sheet in the conveying path, wherein the sheet detecting member is movable between a detecting position in which the sheet detecting member is projected into the sheet conveying path so that the sheet detecting member can be pressed by the sheet in the conveying path, and a retreat position in which the sheet detecting member is retreated from the sheet conveying path; and a detecting sensor configured to detect a presence or absence of the sheet in the sheet conveying path based on a position of the sheet detecting member. The sheet detecting member is moved to the detecting position in association with a movement of the pressure unit to the waiting position, and is moved to the retreat position in association with a movement of the pressure unit to the fixing position.

According to the present invention, the sheet detecting member is moved to the detecting position or the retreat position in association with the movement of rotary member, thereby the sheet detecting member can be moved to the detecting position without an additional drive source only when a sheet is jammed. With the aforementioned measures, the apparatus is simply structured.

Further features of the present invention will become apparent from the following description of exemplary embodiments with reference to the attached drawings.

DESCRIPTION OF THE EMBODIMENTS

Figure 1:
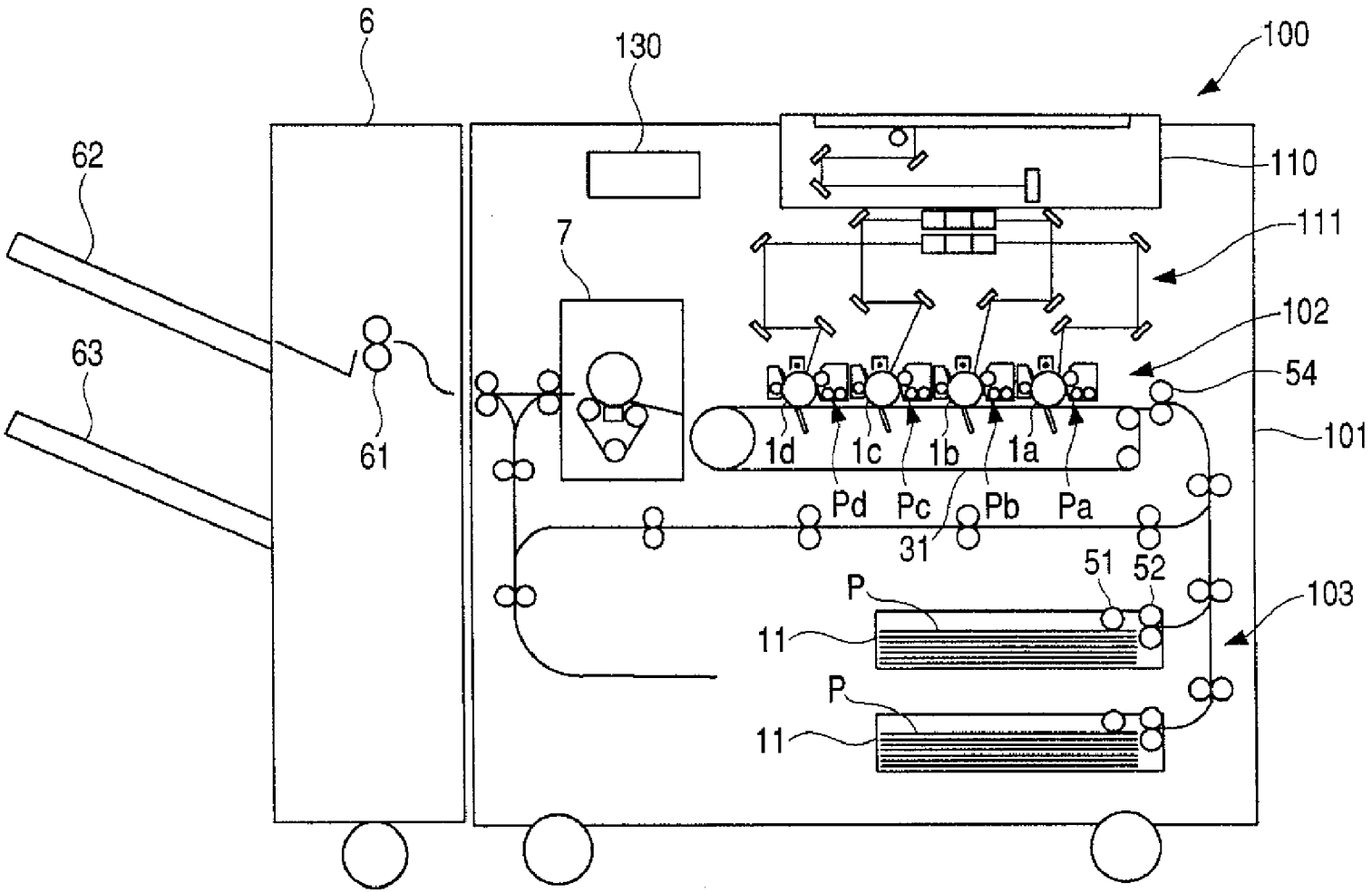
FIG. 1 is a schematic view of a color laser printer as an example of an image forming apparatus provided with a fixing apparatus according to an embodiment of the present invention.

Exemplary embodiments of the present invention will now herein be described below in detail referring to the drawings.

FIG. 1 is a schematic view of a color laser printer as an example of an image forming apparatus provided with a fixing apparatus according to an embodiment of the present invention. A color laser printer 100 has a color laser printer main body 101 (hereinafter referred to as "the printer main body"), an image reading portion 110, and a scanner 111.

The printer main body 101 has an image forming portion 102 to form an image on a sheet P, a sheet conveying portion 103 to convey the sheet P to the image forming portion 102, and a fixing apparatus 7. The image forming portion 102 has process stations Pa, Pb, Pc, and Pd for forming toner images with four colors: yellow (Y), magenta (M), cyan (C), and black (Bk). The process stations Pa to Pd have photosensitive drums 1 (1*a*, 1*b*, 1*c*, and 1*d*) as image-bearing members bearing four color-toner images of yellow, magenta, cyan, and black, respectively, and rotating in the clockwise direction.

Figure 2:
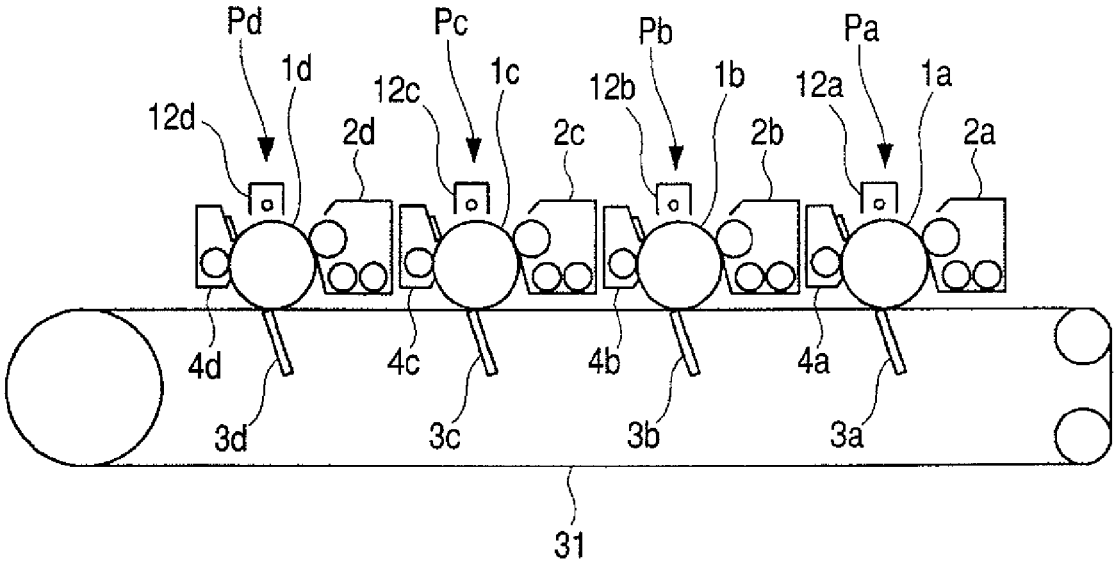
FIG. 2 is a structural view of an example image forming portion of the color laser printer according to an aspect of the present invention.

Further, as illustrated in FIG. 2, the process stations Pa to Pd have the respective developing units 2 (2*a*, 2*b*, 2*c*, and 2*d*), which make yellow toner, magenta toner, cyan toner, and black toner adhere to electrostatic latent images formed on the photosensitive drums to visualize them as toner images, respectively. Also the process stations Pa to Pd have respective cleaning apparatuses 4 (4*a* to 4*d*) which collect the residual toners on the photosensitive drums after transferring the images, and respective charge rollers 12 (12*a* to 12*d*) which uniformly charge the surfaces of the photosensitive drums.

Once the image forming operation begins in the color laser printer 100, laser light emitted from the scanner 111 based on the reading information from the image reading portion 110 irradiates the photosensitive drum 1 of which the surface is uniformly charged by the charge roller 12.

The irradiation creates the respective latent images on the photosensitive drums for yellow (Y), magenta (M), cyan (C), and black (Bk) toners. Then, the developing units 2 develop the latent images to sequentially form the toner images of yellow, magenta, cyan, and black on the respective photosensitive drums.

In parallel to the toner image formation, the sheets P contained in a sheet cassette 11 are picked up by a sheet feeding roller 51, and then separated one by one by a separation roller pair 52. The separated sheet is fed to a registration roller pair 54, which corrects the skew feed of the sheet. After that, the sheet is placed on a transfer belt 31 in synchronism with the image forming operation by a registration roller pair 54, and then is conveyed to a transfer portion in which the transfer belt 31 is in pressure contact with the photosensitive drum 1.

Onto the sheet P thus conveyed to the transfer portion, the toner images in individual colors on the photosensitive drums 1 are sequentially transferred and superposed by the action of transfer rollers 3 (3*a*, 3*b*, 3*c*, and 3*d*) which are located in respective transfer portions as illustrated in FIG. 2 and which are applied with voltage of a polarity opposite to a polarity of the toners. The sheet P on which the four color-toner images are multi-transferred is separated from the transfer belt 31 at a bend portion of the transfer belt 31 starting with the leading edge of the sheet P in the sheet conveying direction, and is conveyed to the fixing apparatus 7.

Then, the sheet P is heated and pressed in the fixing apparatus 7. As a result, respective color toners on the sheet are fused and mixed with one another and are fixed on the sheet, and thus a full-color print image as a permanent image is fixed on the sheet.

The sheet P on which the toner image is thus fixed is conveyed to a discharged sheet processing apparatus 6 to be subjected to a specified sheet processing. After that, the sheet P is discharged onto discharged sheet trays 62 and 63 by a conveying roller 61. The discharged sheet trays 62 and 63 move downward to accept large number of discharged sheets being piled.

Figure 3:
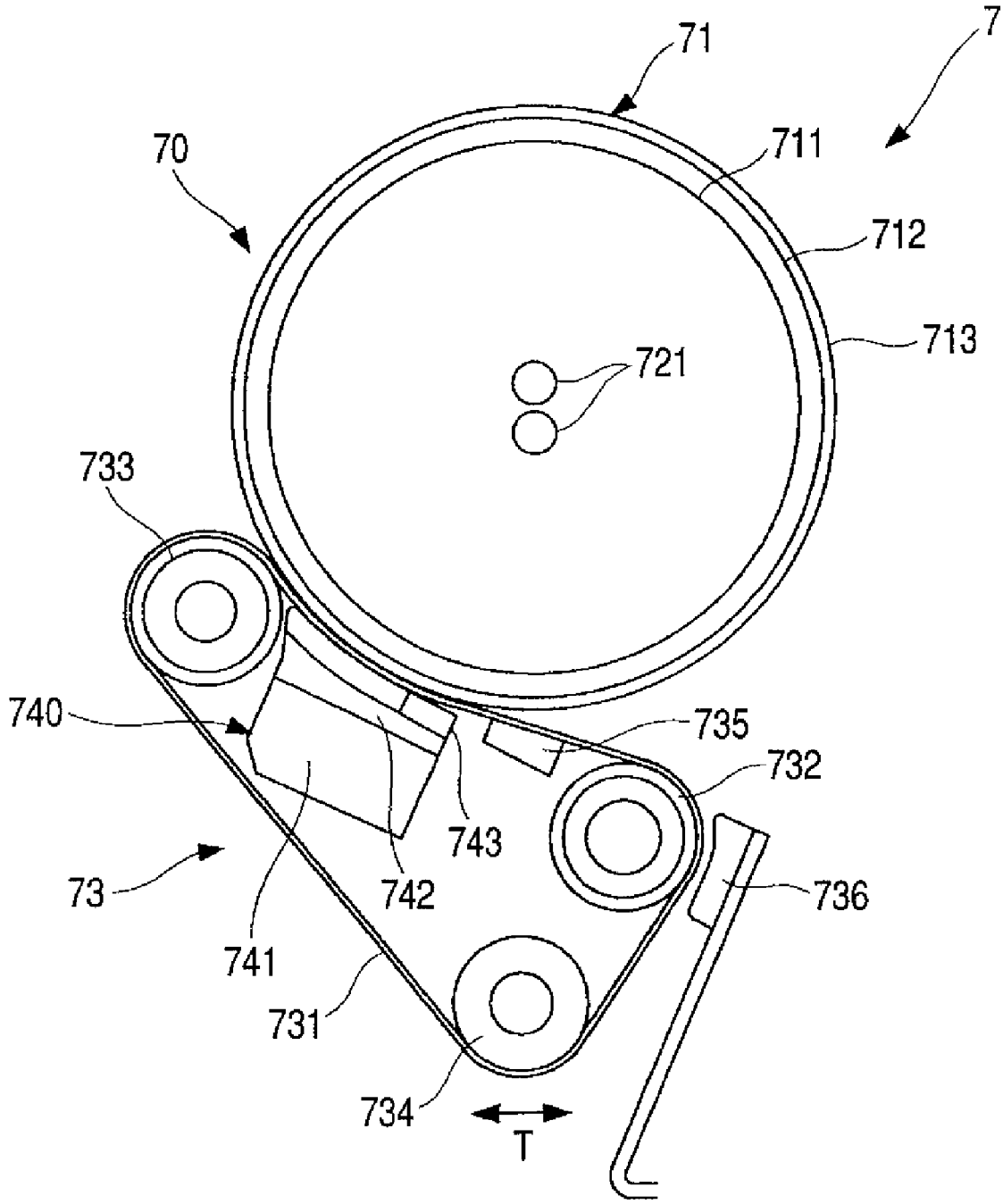
FIG. 3 is a view illustrating an example structure of the fixing apparatus provided on the color laser printer according to an aspect of the present invention.

As illustrated in FIG. 3, the fixing apparatus 7 includes a fixing roller portion 70 provided with a fixing roller 71 which is a fixing rotary member having a heat source, a fixing belt 731, and a fixing belt unit 73 which is a pressure unit having a pressure pad portion 740.

The fixing roller 71 has an elastic layer 712 made of silicon rubber formed on the surface layer of a core metal 711 made of aluminum, and a releasing layer 713 made of PFT tube provided on the surface layer of the elastic layer 712 to improve the releasability of the toner. In addition, a heater 721 as a heat source is positioned in the fixing roller near the center of the fixing roller.

The fixing belt 731, which is a pressure rotary member separable from the fixing roller 71 and brought into pressure contact with the fixing roller 71 of the fixing belt unit 73 is passed around an inlet roller 732, a separation roller 733, and a steering roller 734. The separation roller 733 is made of metal such as stainless steel (SUS), and is in pressure contact with the fixing roller 71 via the fixing belt 731. One end of the steering roller 734 is movable in directions indicated by the double-headed arrow T to correct the deviation of the fixing belt 731.

The pressure pad portion 740 is positioned between the inlet roller 732 and the separation roller 733, and has a base 741 made of metal such as stainless steel (SUS), a pressure pad 742, and a slide sheet 743, which is disposed between the pressure pad 742 and the fixing belt 731. The slide sheet 743 is made of PI film, and the pressure pad 742 is made of silicon rubber.

An oil felt 735 impregnated with silicone oil is disposed between the inlet roller 732 and the pressure pad portion 740. The oil felt 735 applies oil on the inner surface of the fixing belt 731 to decrease the friction force between the fixing belt 731 and the slide sheet 743.

Figure 4:
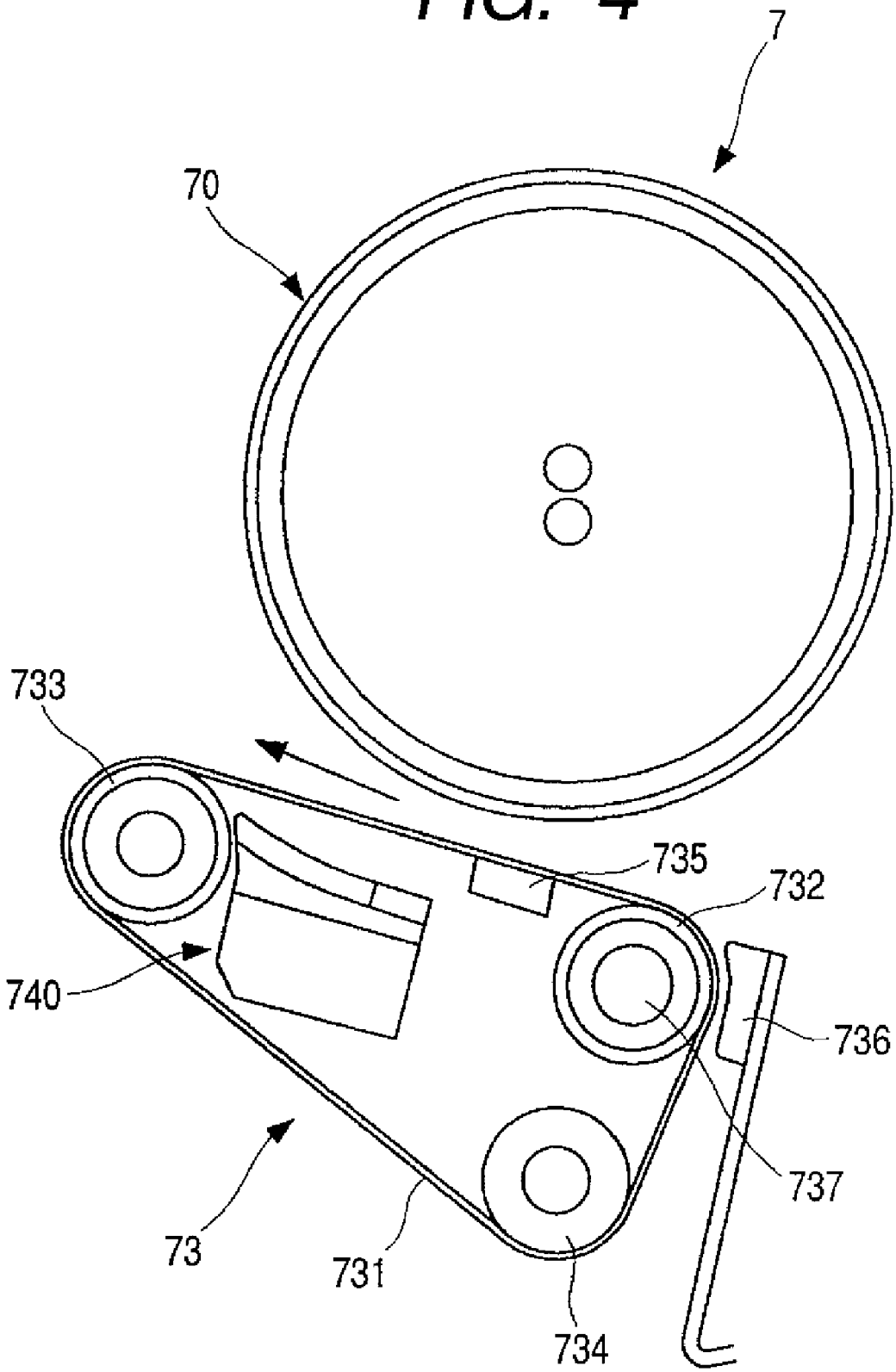
FIG. 4 is a view illustrating an example state of the fixing apparatus in a waiting operation according to an aspect of the present invention.

Furthermore, when a coat paper is used, it is necessary to prevent the problem of evaporation of water contained inside the coat paper, as described above. To this end, with respect to the image forming operation illustrated in FIG. 3, the fixing belt unit 73 is retreated relative to the fixing roller 71 in a waiting state as illustrated in FIG. 4 lest the fixing belt 731 contact with the fixing roller 71. Furthermore, a heater 737 is provided in the inlet roller 732 to heat the fixing belt 731.

In the state of FIG. 4, a drive source (not shown) rotates the fixing belt 731 in the direction indicated by the arrow, and at the same time, the heater 737 in the inlet roller 732 heats the fixing belt 731 through the inlet roller 732 to keep the temperature of the fixing belt 731 constant with a thermistor 736.

The temperature of the fixing belt 731 is set to a temperature lower than the temperature of the fixing roller 71 to some degree. As a result, the heat applied to the backside of the coat paper can be reduced so that the evaporation of water in the coat paper can be reduced, thereby preventing the above phenomenon from occurring.

The pressure mechanism of the fixing belt unit 73 to bring the fixing belt unit 73 into contact with the fixing roller 71 and separate the fixing belt unit 73 from the fixing roller 71 is described below referring to FIG. 5.

A pressure mechanism 75 brings the fixing belt unit 73 into contact with the fixing roller 71 and separates the fixing belt unit 73 from the fixing roller 71. The pressure mechanism 75 is provided at each end of the fixing belt unit 73. FIG. 5 illustrates an example of one of the pressure mechanisms 75.

The pressure mechanism 75 holds the inlet roller 732 and the separation roller 733 through bearings 732*a* and 733*a* rotatably, and has a roller pressure holder 751 rotatable about a rotary shaft 754. Also the pressure mechanism 75 holds (a base 741 of) a pressure pad portion 740, and has a pad pressure holder 752 rotatable about the rotary shaft 754.

Furthermore, the pressure mechanism 75 has a pressure holder 753 rotatable about the rotary shaft 754. The pressure holder 753 is disposed below the roller pressure holder 751 and the pad pressure holder 752, and supports the roller pressure holder 751 and the pad pressure holder 752 from below.

A roller pressure spring 757 is disposed between the pressure holder 753 and the roller pressure holder 751. A first guide shaft 755 fixed to the pressure holder 753 extends through the roller pressure spring 757 and a hole (not shown) provided in the roller pressure holder 751, and then the upper end of the first guide shaft 755 projects above form the roller pressure holder 751. Furthermore, the upper end of the first guide shaft 755 is provided with a stopper portion 755*a*.

A pad pressure spring 758 is disposed between the pressure holder 753 and the pad pressure holder 752. A second guide shaft 756 fixed to the pressure holder 753 extends through the pad pressure spring 758 and a hole (not shown) provided in the pad pressure holder 752, and then the upper end of the second guide shaft 756 is projected above from the pad pressure holder 752. Furthermore, the upper end of the second guide shaft 756 is provided with a stopper portion 756*a*.

Further, the pressure holder 753 has a receiving portion 759 which contacts with a pressure cam 761 which is fixed to a shaft 760 rotated by a drive device (not shown) provided in the printer main body 101. The rotation of the pressure cam 761 rotates the pressure holder 753 about the rotary shaft 754 in the vertical direction. In association with the rotation of the pressure holder 753, the roller pressure holder 751 and the pad pressure holder 752 also rotates in the vertical direction as described later.

A pad pressure stay 762 connects the pad pressure holders 752 provided at both ends of the pad pressure stay 762. On the pad pressure stay 762 at almost center in width direction perpendicular to the sheet conveying direction, there are provided the thermistor 736 and a sensor oscillation lever 763, which oscillates a sheet presence or absence detecting sensor 780 as described later.

The sheet guide 770 is a guide member provided on the upstream side of the inlet roller 732 in the sheet conveying direction. The sheet guide 770 guides the leading edge of the sheet into the fixing nip formed by pressing the fixing belt unit 73 against the fixing roller 71. The sheet guide 770 forms a conveying path 301 (see FIG. 6) through which the sheet is conveyed. The sheet guide 770 has a sensor supporting table 771. The sheet presence or absence detecting sensor 780 is rotatably provided on the sensor supporting table 771.

The sheet presence or absence detecting sensor 780 has a sensor table 781 which is a body portion rotatable about a rotary shaft 781*b*, a sensor lever 783 as a sheet detecting member provided rotatably about a shaft 782 on the sensor table 781, and a photo-interrupter 784.

Further, the sensor lever 783 has a contact portion 783*b* projecting from the sheet guide 770 by a spring 785, and a shutter portion 783*a* to shield the photo-interrupter 784. The sheet guide 770 is provided with an opening (not shown) through which the contact portion 783*b* of the sensor lever 783 is projected from the sheet guide 770.

Figure 5:
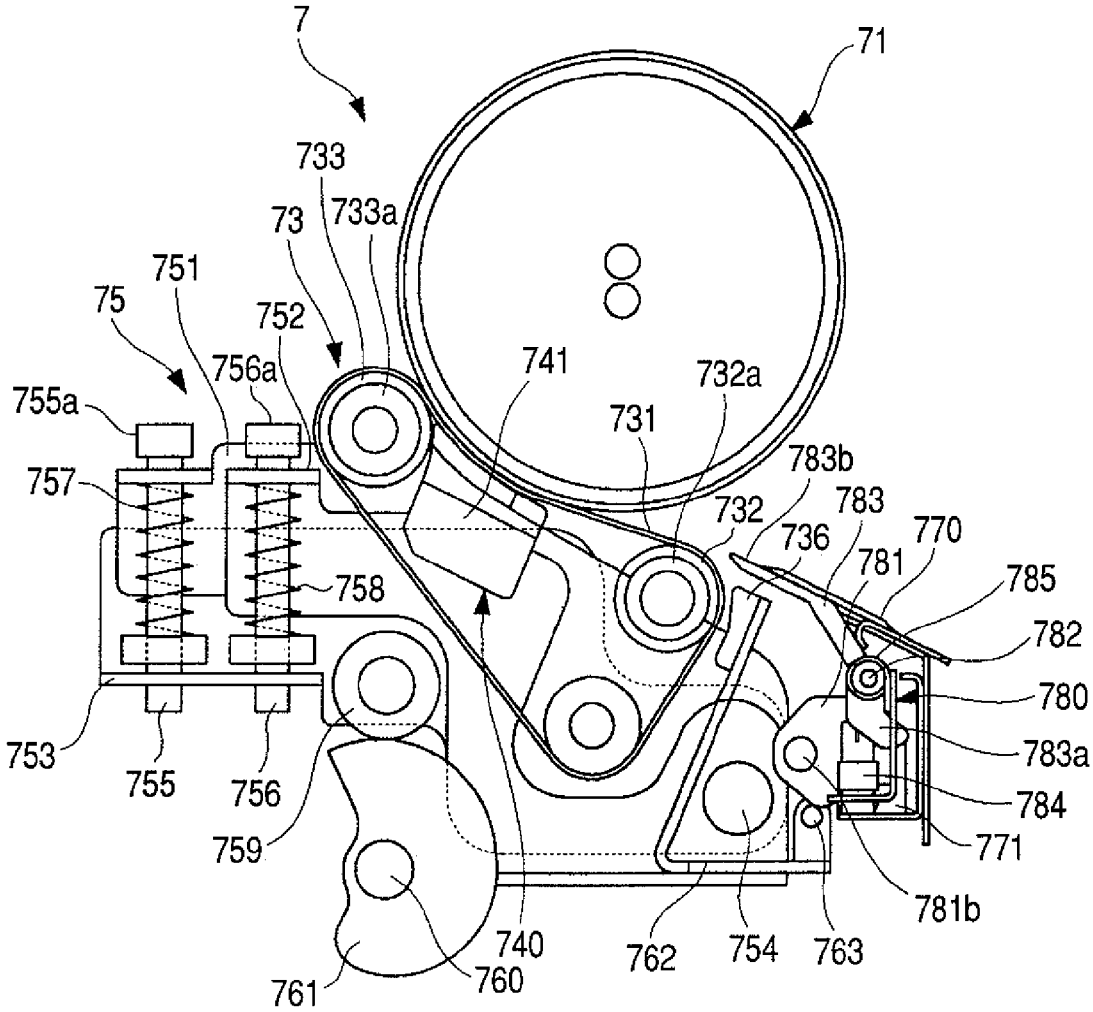
FIG. 5 is a view illustrating an example structure of a pressure mechanism of a fixing belt unit provided in the fixing apparatus according to an aspect of the present invention.

During the normal image forming operation, in the sheet presence or absence detecting sensor 780, the shutter portion 783*a* is moved to a position for shielding the photo-interrupter 784, as illustrated in FIG. 5.

The output of the sheet presence or absence detecting sensor 780 enters a controller 130 provided in the printer main body 101, as illustrated in FIG. 1. The controller 130 detects the presence or absence of a sheet in the fixing nip based on a signal from the sheet presence or absence detecting sensor 780.

Figure 6:
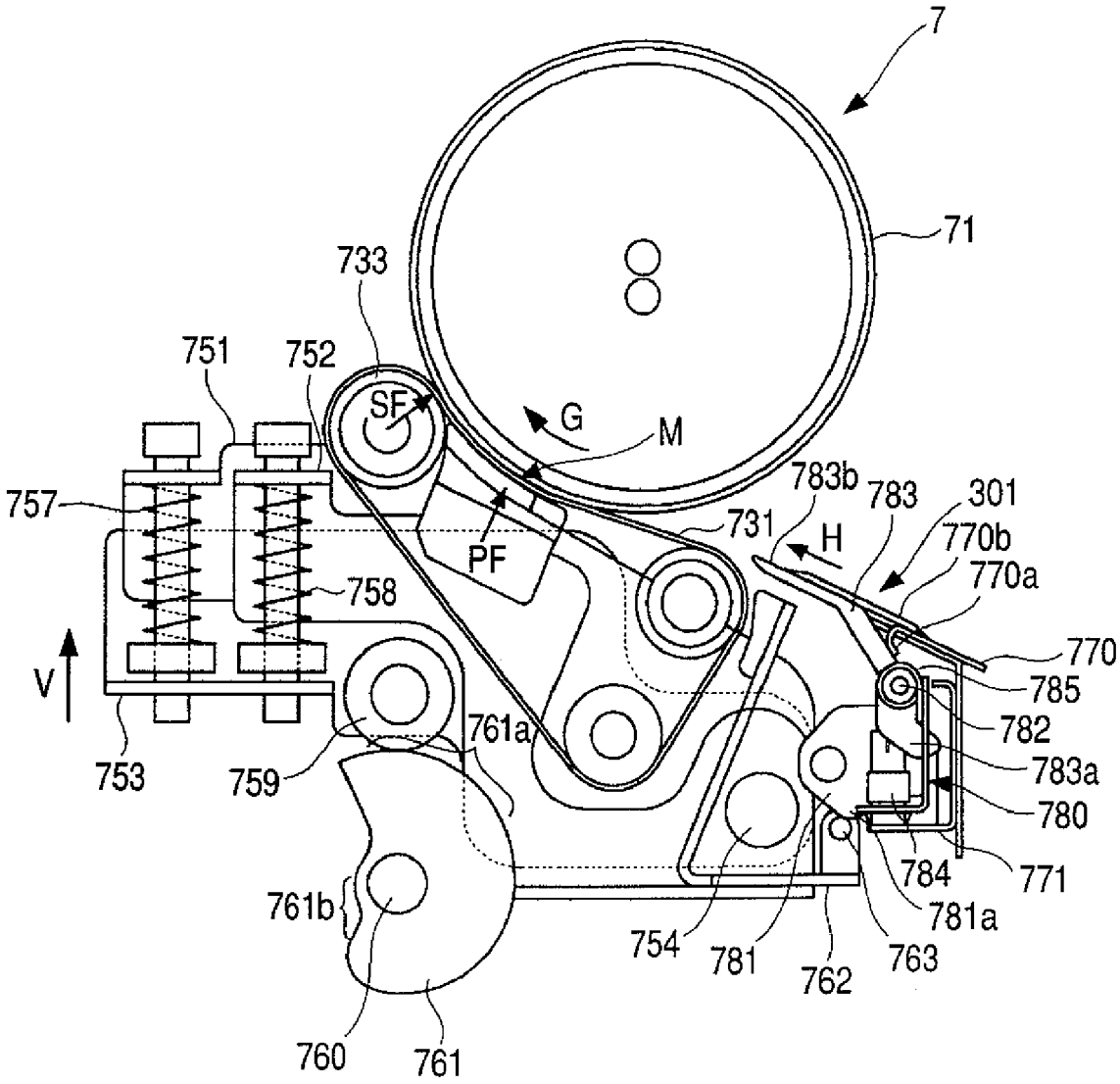
FIG. 6 is a view illustrating an example pressure mechanism in an image forming operation according to an aspect of the present invention.

Once an image forming signal enters the pressure mechanism 75 having the above construction, a drive system (not shown) rotates the rotary shaft 760, and thereby the pressure cam 761 rotates as illustrated in FIG. 6. When a major axis portion 761*a* of the pressure cam 761 comes to a top position, the receiving portion 759 is lifted upward, thereby rotating the pressure holder 753 about the rotary shaft 754 and upward in the direction indicated by the arrow V.

When the pressure holder 753 thus rotates upward, the roller pressure holder 751 is pressed by the roller pressure spring 757 to rotate upward about the rotary shaft 754, and the fixing belt 731 is pressed against the fixing roller 71 by a pressure force SF via the separation roller 733. Similarly, the pad pressure holder 752 is urged by the pad pressure spring 758 to rotate upward about the rotary shaft 754, and the fixing belt 731 is pressed against the fixing roller 71 by a pressure force PF via the fixing pad portion 740.

At this moment, the sensor oscillation lever 763 provided on the pad pressure stay 762 is separated from a pressing portion 781*a* positioned at a lower end of the sensor table 781. In this state, the sensor lever 783 contacts with a stopper portion 770*a* of the sheet guide 770, thus the sensor lever 783 is held at a retreat position.

When the fixing roller 71 rotates in the direction indicated by the arrow G in this state, the fixing belt 731 also rotates in the direction indicated by the arrow G following the rotation of the fixing roller 71. After that, when the sheet conveyed in the direction indicated by the arrow H enters a fixing nip (a pressure contact portion) M between the fixing roller 71 and the fixing belt 731, the toner on the sheet is fused by the heat of the fixing roller 71 and the fixing belt 731. By the pressure of the pressure pad portion 740, the toner is pressed against the sheet and fixed on the sheet.

According to the embodiment, the retreat position of the sensor lever 783 is selected to a position in which the contact portion 783*b* of the sensor lever 783 is substantially coplanar with the sheet guide surface 770*b* without projecting above from a sheet guide surface 770*b* of the sheet guide 770.

By selecting the retreat position of the sensor lever 783 to that position, the sheet can enter the fixing nip M without being caught by the sensor lever 783. In addition, the sheet can enter the fixing nip M without being caught by an opening (not shown), which is formed in the sheet guide 770 to allow the contact portion 783*b* of the sensor lever 783 to project from the sheet guide 770 through the opening.

By retreating the sensor lever 783 during the image forming operation to the retreat position in which the sensor lever 783 is substantially coplanar with the sheet guide surface 770*b*, the unstable behavior of the sheet and the deformation of the sheet caused by the leading edge of the sheet contacting with the sensor lever 783 can be avoided. As a result, the shape of the sheet entering the fixing nip M is stabilized, and good fixation can be performed.

During the above operation, the shutter portion 783*a* shields the photo-interrupter 784, and thereby the sheet presence or absence detecting sensor 780 is turned ON. In the embodiment, however, even if the sheet presence or absence detecting sensor 780 is turned ON to send a signal, the controller 130 ignores the signal when no jamming has occurred in the printer main body 101.

Figure 7:
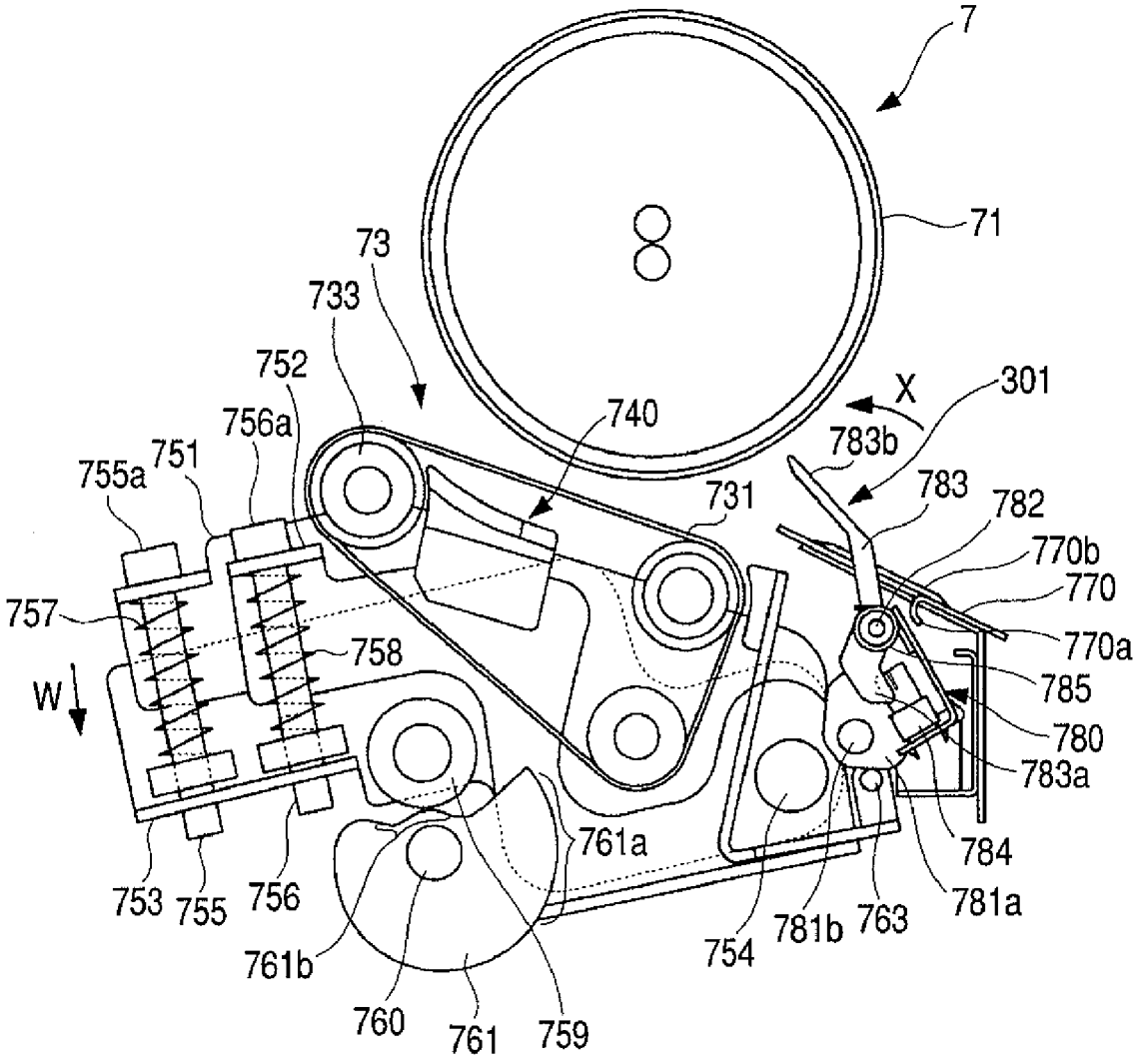
FIG. 7 is a view illustrating the pressure mechanism in the waiting operation according to an aspect of the present invention.

On the other hand, in a state that no sheet is conveyed or in a state that the apparatus is in a standby state for waiting output of the image, the pressure cam 761 rotates, as illustrated in FIG. 7, to assume a state that a minor axis portion 761*b* of the pressure cam 761 comes to the top position. In this state, the pressure holder 753 along with the receiving portion 759 rotates about the rotary shaft 754 downward in the direction indicated by the arrow W with the aid of the gravitational force of the pressure holder 753 or by an urging unit (not shown).

Once the pressure holder 753 thus rotates downward, the roller pressure holder 751 is locked by the stopper portion 755*a* on the upper end of the first guide shaft 755 to rotate downward about the rotary shaft 754, and then the separation roller 733 and the fixing belt 731 are separated from the fixing roller 71. Similarly, the pad pressure holder 752 is locked by the stopper portion 756*a* on the upper end of the second guide shaft 756 to rotate downward about the rotary shaft 754, and then the fixing pad portion 740 and the fixing belt 731 are separated from the fixing roller 71.

As a result, with the pressure mechanism 75, the fixing belt unit 73 (the fixing belt 731) can be moved between a fixing position in which the fixing belt 731 is in pressure contact with the fixing roller 71 and a waiting position in which the fixing belt 731 is separated from the fixing roller 71.

Furthermore, when the pressure holder 753 is rotated downward as described above, the sensor oscillation lever 763 provided on the pad pressure stay 762 constituting the interlocking member is rotated upward to press upward the pressing portion 781*a* on the sensor table 781 from below. When the sensor table 781 is pressed upward from below, the sensor table 781 is rotated about the rotary shaft 781*b* in the direction indicated by the arrow X against the urging force of the urging unit (not shown), thereby releasing the lock of the sensor lever 783 from the stopper portion 770*a* of the sheet guide 770.

As a result, by the spring 785, the sensor lever 783 moves to a position in which the contact portion 783*b* is projected above from the sheet guide surface 770*b*. The position of the sensor lever 783 illustrated in FIG. 7 is a detection position in which the contact portion 783*b* of the sensor lever 783 projects from the sheet guides 770 into the conveying path 301 so that the contact portion 783*b* can be pressed by the sheet in the conveying path 301. If there is no sheet in the conveying path 301, the shutter portion 783*a* moves to a position not shielding the photo-interrupter 584, as illustrated in FIG. 7. According to the embodiment, the pad pressure stay 762, the sensor table 781, the stopper portion 770*a*, and the spring 785 constitute an interlocking mechanism which links the movement of the pressure holder 753 with the movement of the sensor lever 783.

With the fixing apparatus 7 having the above structure, when a jamming of a sheet occurs in the printer main body 101, the controller 130 controls the pressure mechanism 75 to move the fixing belt unit 73 and the sensor lever 783 to the position illustrated in FIG. 7.

Figure 8:
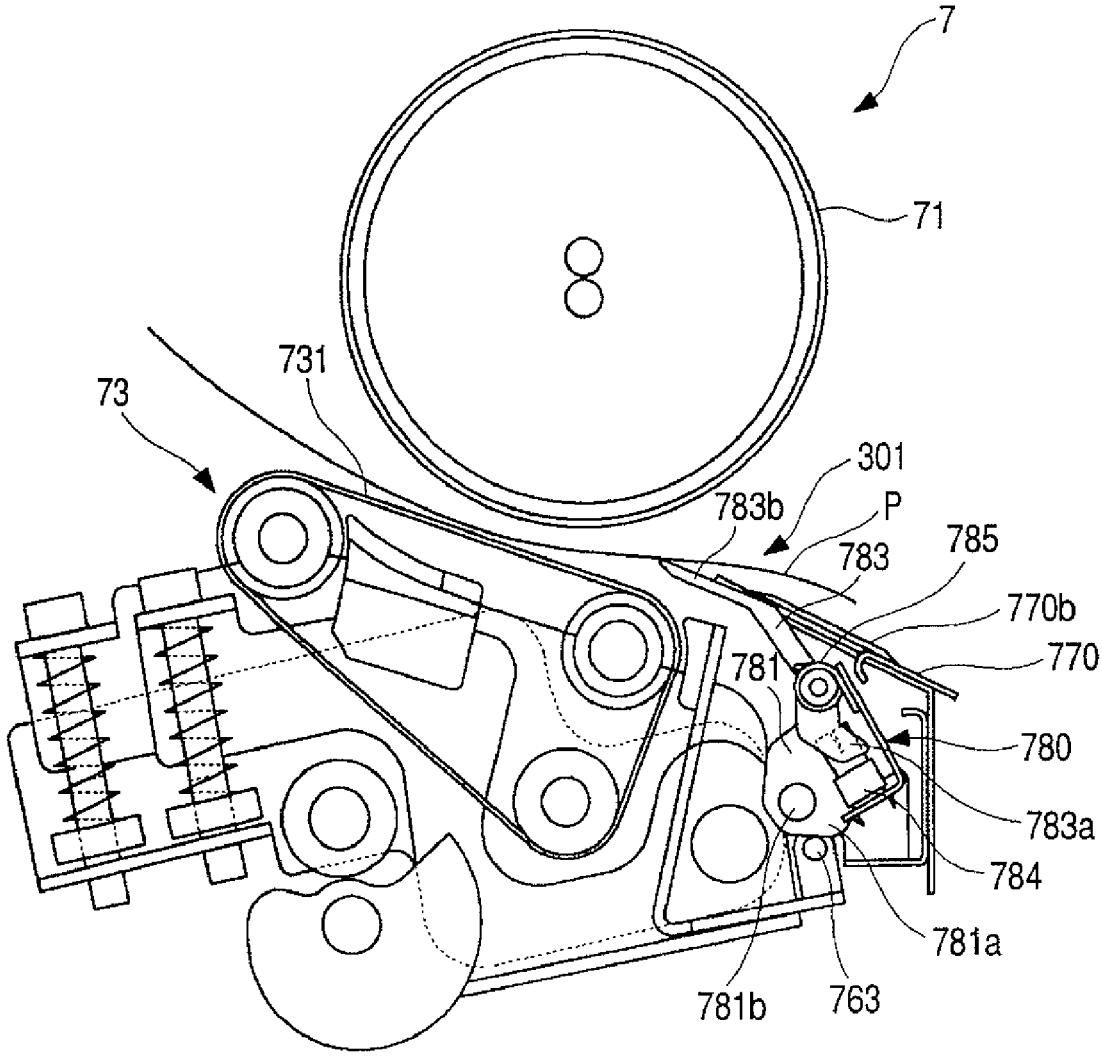
FIG. 8 is a view illustrating an example state in which a sheet remains in the fixing apparatus according to an aspect of the present invention.

If a jamming of a sheet occurs between the fixing roller 71 and the fixing belt unit 73, the condition becomes as illustrated in FIG. 8. When the sensor lever 783 is to be rotated upward by the pressure mechanism 75, the sensor lever 783 is pressed by the jammed sheet P so as to be moved to the position for shielding the photo-interrupter 584. When that state is established, the sheet presence or absence detecting sensor 780 is turned ON. At that moment, the controller 130 detects that the jammed sheet P is present between the fixing roller 71 and the fixing belt unit 73, and thus the sheet P is residual.

Figure 9:
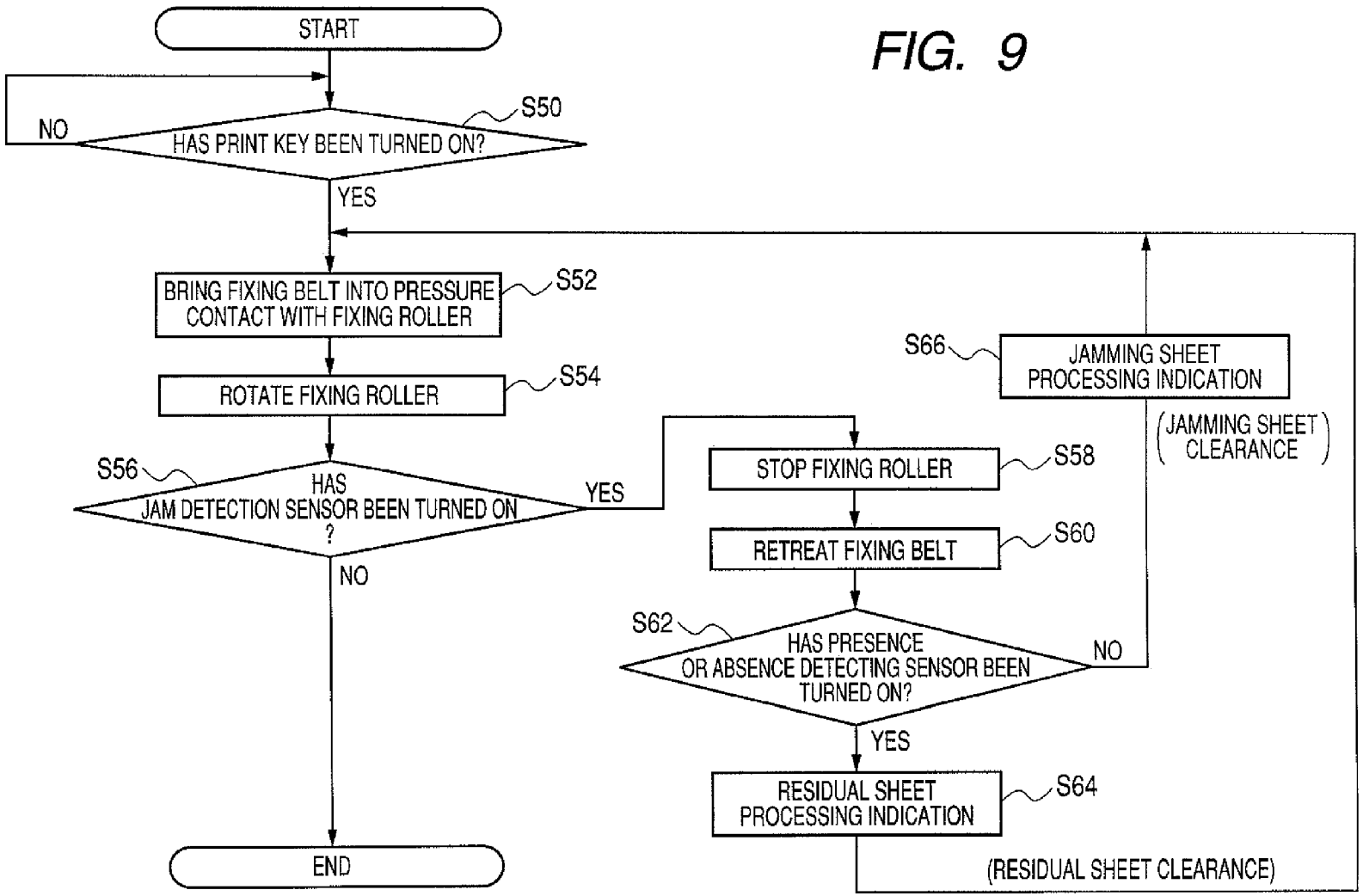
FIG. 9 is a flowchart illustrating an example operation of detecting a residual sheet according to an aspect of the present invention.
Figure 10:
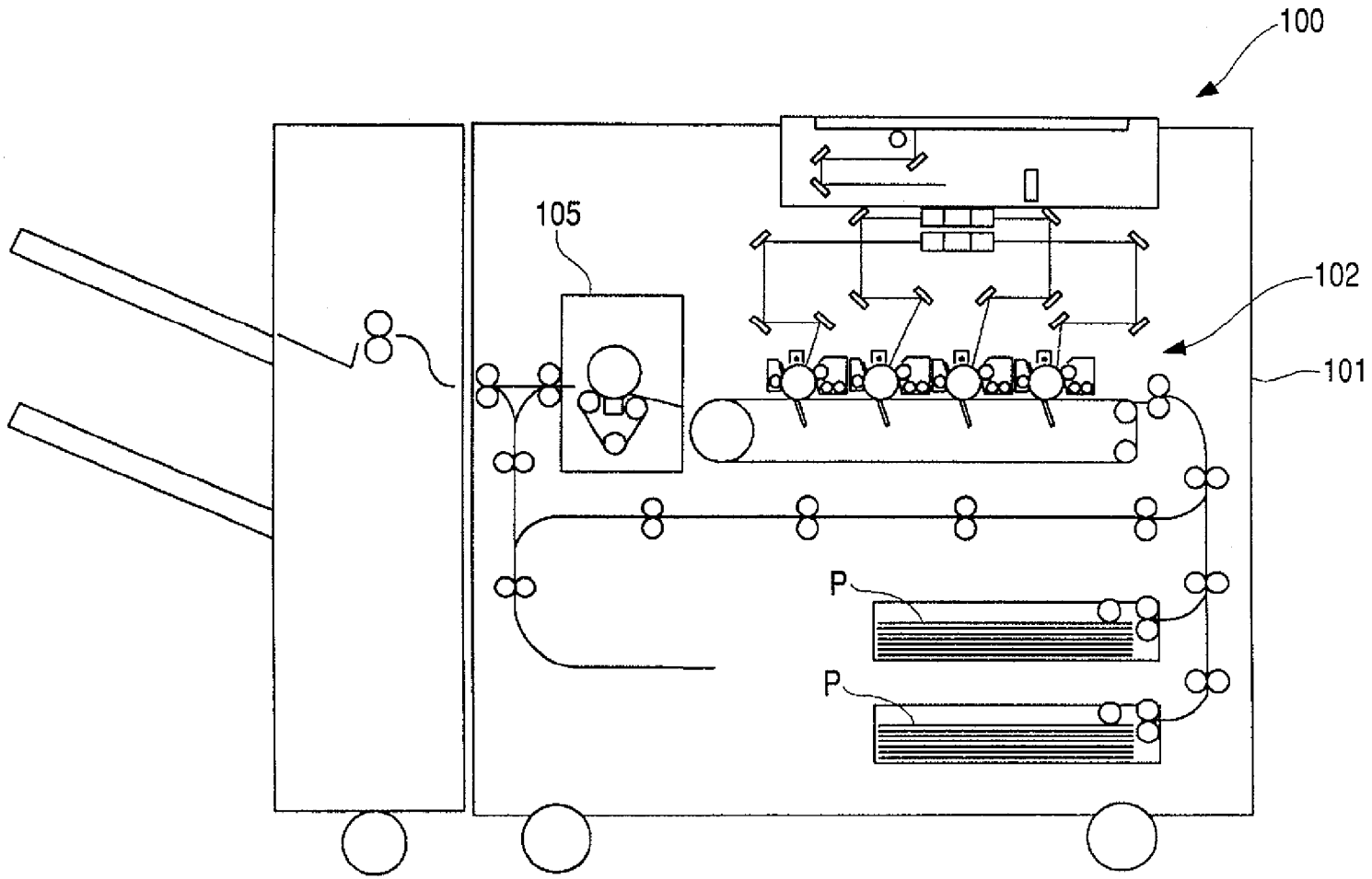
FIG. 10 PRIOR ART
FIG. 10 is a schematic view of a color laser printer as an example of an image forming apparatus provided with a conventional fixing apparatus.
Figure 11:
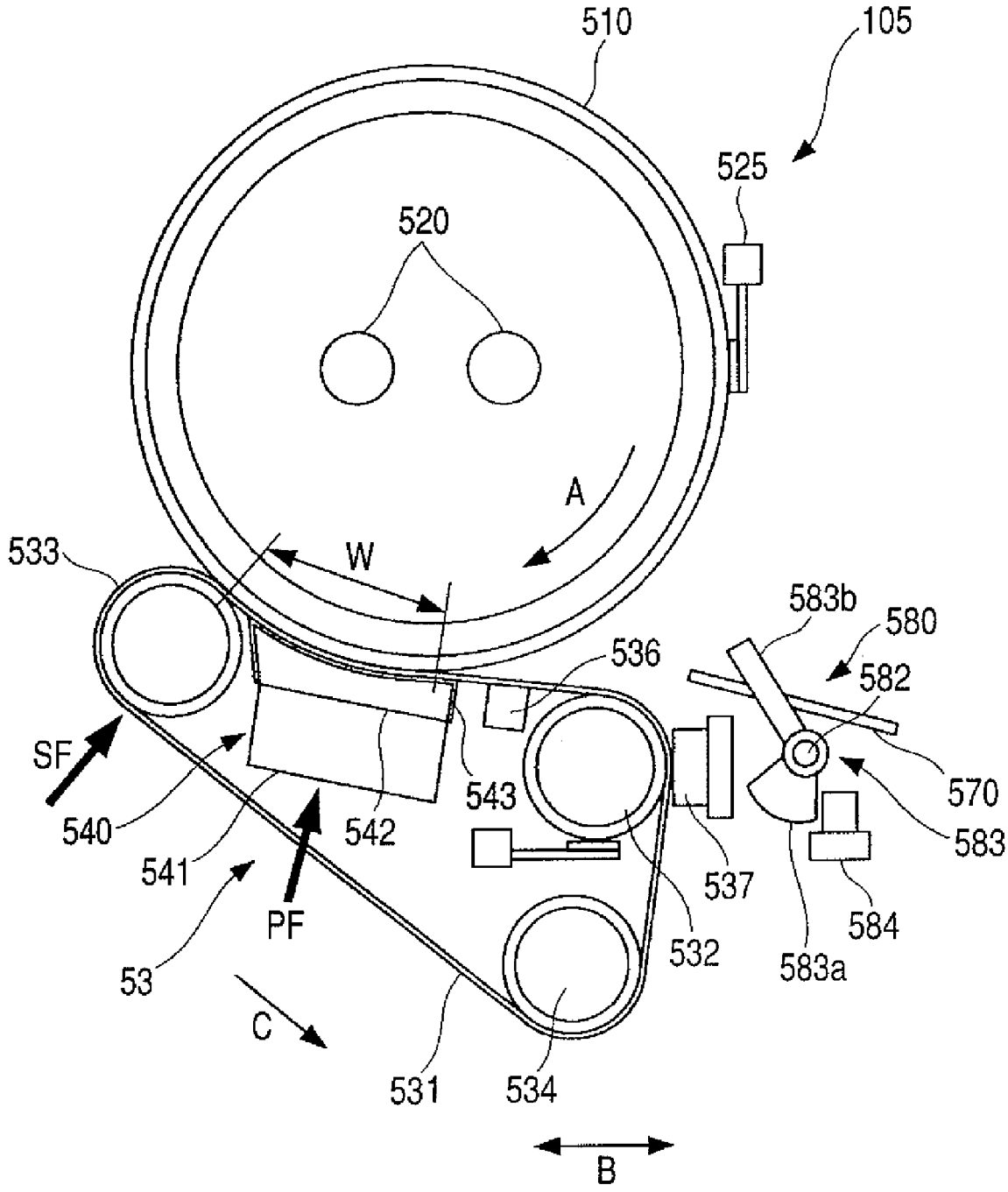
FIG. 11 PRIOR ART
FIG. 11 is a view illustrating a structure of the conventional fixing apparatus.
Figure 12A:
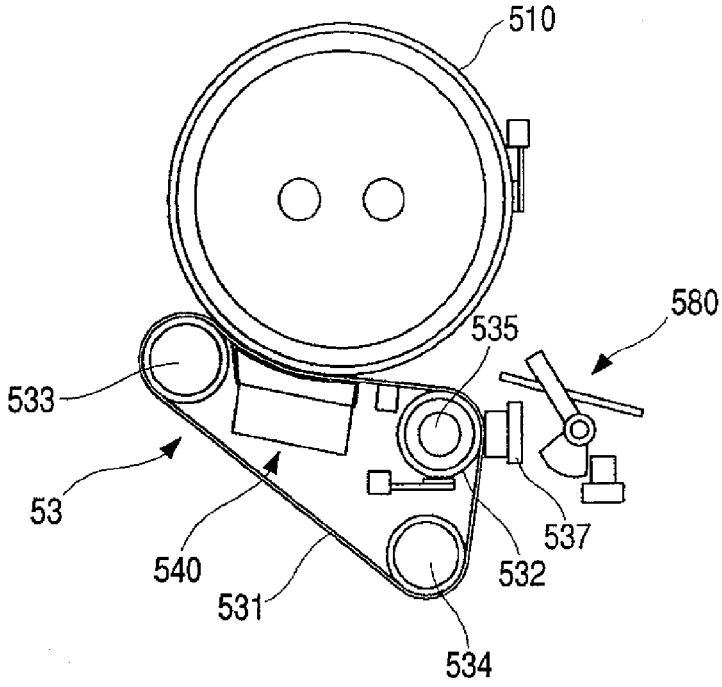
FIG. 12A PRIOR ART
FIG. 12A is a view of the conventional fixing apparatus in an image forming operation.
Figure 12B:
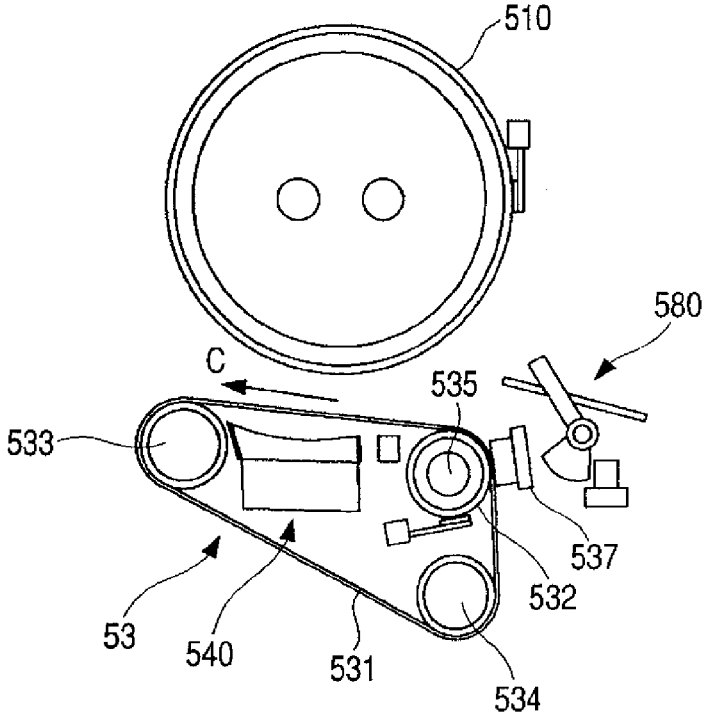
FIG. 12B PRIOR ART
FIG. 12B is a view of the conventional fixing apparatus in a waiting operation.

Next, an example detection operation of a residual sheet will be described referring to the flowchart of FIG. 9.

In the normal condition, when the print key (not shown) provided on the printer main body 101 is turned ON, (YES of S50), the pressure mechanism 75 is actuated. The fixing belt 731 is brought into pressure contact with the fixing roller 71 (S52) as illustrated in FIG. 6, and the fixing roller 71 is rotated (S54). After that, the print operation begins to feed the sheet to the image forming portion. A toner image is formed on the sheet. When the sheet is fed to the fixing apparatus 7, the fixing apparatus 7 fixes the toner image on the sheet. Then, as far as no jamming occurs and the jamming detecting sensor (not shown) is not turned ON (NO of S56), the sheet is discharged onto the discharged sheet tray, thus the print operation completes. These actions are controlled by the controller 130.

When, however, the jamming detecting sensor (not shown) is turned ON (YES of S56) by detecting that a jamming of a sheet occurs during a sheet conveyance after the print operation begins, the jamming detecting sensor outputs a detection signal to the controller 130. Based on the detection signal, the controller 130 immediately stops the fixing roller 71 (S58), and further drives the pressure mechanism 75 to separate the fixing belt 731 from the fixing roller 71 (S60). Thereby, the fixing apparatus 7 is changed from the state as illustrated in FIG. 6 to the state as illustrated in FIG. 8 as described above.

When the jammed sheet is removed, the state of FIG. 8 is changed to the state of FIG. 7. In this state, the sheet presence or absence detecting sensor 780 is turned OFF, and the controller 130 determines that the jammed sheet P is removed.

If the operator failed to recognize a jammed sheet in the fixing apparatus 7, and if the jammed sheet is not removed from the fixing apparatus 7 as illustrated in FIG. 8, the sensor lever 783 stays in a state of being pressed by the sheet P. As a result, the shutter portion 783*a* continues to shield the photo-interrupter 784, which leaves the sheet presence or absence detecting sensor 780 in the turned-ON state.

Now referring back to FIG. 9, if the sheet presence or absence detecting sensor 780 is turned ON (YES of S62), the controller 130 receives the signal from the sheet presence or absence detecting sensor 780, and displays the residual sheet processing indication on the operation portion (not shown) based on the signal (S64). After that, when the operator has removed the residual sheet in accordance with the residual sheet processing indication, the apparatus is allowed to receive the image forming signal again so that an image formation is enabled.

On the other hand, even if the residual sheet is removed and the sheet presence or absence detecting sensor 780 is turned OFF (NO of S62), when the jamming detecting sensor stays in the turned-ON state (YES of S56), the controller 130 detects the occurrence position of the jamming other than the fixing apparatus 7. Then, the controller 130 displays the jamming processing indication at the jamming occurrence position on the operation portion (not shown) (S66). After that, when the operator has removed the residual sheet in accordance with the residual sheet processing indication, the apparatus is allowed to receive the image forming signal again so that an image formation is enabled.

As described above, by moving the sensor lever 783 between the detection position and the retreat position in association with the movement of the fixing belt unit 73, the sensor lever 783 can be moved to the detection position only in case of sheet jamming. That is, according to the embodiment, an interlocking mechanism is provided to link the movement of the fixing belt unit 73 with the movement of the sensor lever 783, thereby moving the sensor lever 783 between the detection position and the retreat position by the interlocking mechanism. As a result, the deformation of the leading edge of a sheet is prevented with a simple structure without adding any drive source, and the occurrence of a poor fixation can be prevented.

While the present invention has been described with reference to exemplary embodiments, it is to be understood that the invention is not limited to the disclosed exemplary embodiments. The scope of following claims is to be accorded the broadest interpretation so as to encompass all such modifications and equivalent structures and functions.

This application claims the benefit of Japanese Patent Application No. 2006-071871, filed Mar. 15, 2006, which is incorporated herein by reference in its entirety.

What is claimed:

1. A fixing apparatus having a fixing rotary member and a pressure rotary member, wherein the pressure rotary member is configured to be separable from and in pressure contact with the fixing rotary member, and wherein the fixing rotary member and the pressure rotary member are configured to fix a toner image onto a sheet, the fixing apparatus comprising:

a pressure unit which includes the pressure rotary member and which is configured to be movable between a fixing position in which the pressure rotary member is in pressure contact with the fixing rotary member and a waiting position in which the pressure rotary member is separated from the fixing rotary member;

a guide member which forms a conveying path to guide a sheet on which the toner image is fixed by the fixing rotary member and the pressure rotary member;

a sheet detecting member which is configured to be movable by being pressed by the sheet in the conveying path, wherein the sheet detecting member is movable between a detecting position in which the sheet detecting member is projected into the sheet conveying path so that the sheet detecting member can be pressed by the sheet in the conveying path, and a retreat position in which the sheet detecting member is retreated from the sheet conveying path; and a detecting sensor configured to detect a presence or absence of the sheet in the sheet conveying path based on a position of the sheet detecting member, wherein the sheet detecting member is moved to the detecting position in association with a movement of the pressure unit to the waiting position, and is moved to the retreat position in association with a movement of the pressure unit to the fixing position.

2. A fixing apparatus according to claim 1, further comprising:

a holder configured to hold the sheet detecting member; and an interlocking member configured to rotate the holder in association with the movement of the pressure unit so that the sheet detecting member is moved between the detecting position and the retreat position.

3. A fixing apparatus according to claim 1, wherein a surface of the sheet detecting member is substantially coplanar with a sheet contact surface of the guide member when the sheet detecting member is moved to the retreat position.

4. A fixing apparatus according to claim 1, wherein the pressure rotary member is a fixing belt in a shape of an endless belt.

5. An image forming apparatus comprising:

an image forming portion configured to form a toner image on a sheet; and a fixing apparatus configured to fix the toner image formed by the image forming portion onto the sheet, the fixing apparatus including, a fixing rotary member and a pressure rotary member, wherein the pressure rotary member is configured to be separable from and in pressure contact with the fixing rotary member, and wherein the fixing rotary member and the pressure rotary member are configured to fix a toner image onto a sheet;

a pressure unit which includes the pressure rotary member and which is configured to be movable between a fixing position in which the pressure rotary member is in pressure contact with the fixing rotary member and a waiting position in which the pressure rotary member is separated from the fixing rotary member;

a guide member which forms a conveying path to guide a sheet on which the toner image is fixed by the fixing rotary member and the pressure rotary member;

a sheet detecting member which is configured to be movable by being pressed by the sheet in the conveying path, wherein the sheet detecting member is movable between a detecting position in which the sheet detecting member is projected into the sheet conveying path so that the sheet detecting member can be pressed by the sheet in the conveying path, and a retreat position in which the sheet detecting member is retreated from the sheet conveying path; and a detecting sensor configured to detect a presence or absence of the sheet in the sheet conveying path based on a position of the sheet detecting member, wherein the sheet detecting member is moved to the detecting position in association with a movement of the pressure unit to the waiting position, and is moved to the retreat position in association with a movement of the pressure unit to the fixing position.

6. A sheet conveying apparatus comprising:

a first rotary member;

a second rotary member configured to convey a sheet with the first rotary member and which is separable from and in contact with the first rotary member;

a sheet detecting member which is movable by being pressed by the sheet; and a detecting sensor configured to detect a presence or absence of the sheet based on a position of the sheet detecting member, wherein the sheet detecting member is movable between a detecting position for detecting a presence or absence of the sheet by the detecting sensor in which the sheet detecting member can be pressed by the sheet and a retreat position in which the sheet detecting member is retreated from the detecting position, and wherein the sheet detecting member is moved to the detecting position from the retract position in association with a movement of the second rotary member away from the first rotary member.

7. A sheet conveying apparatus according to claim 6, further comprising:

an interlocking member configured to interlock the detecting member with the movement of the second rotary member.

* * * * *